US005078638A

United States Patent [19]

Molina

[11] Patent Number: 5,078,638

[45] Date of Patent: Jan. 7, 1992

[54] POWER AND CONTROL MODULE FOR MODEL AIRPLANES

[76] Inventor: Joseph Molina, 6931 Glenview La., Lino Lakes, Minn. 55014

[21] Appl. No.: 339,077

[22] Filed: Apr. 14, 1989

[51] Int. Cl.[5] ..... A63H 27/24

[52] U.S. Cl. ..... 446/57; 446/34; 244/54

[58] Field of Search ..... 446/56–58, 446/33, 34, 37, 456; 244/54, 55, 189, 190, 120

[56] References Cited

U.S. PATENT DOCUMENTS

| | | | |
|---|---|---|---|
| 3,590,517 | 7/1971 | Regehr et al. . | |
| 3,777,420 | 12/1973 | Bosley et al. | 446/58 |
| 3,908,305 | 9/1975 | Schroeder . | |
| 3,914,899 | 10/1975 | Mabuchi | 446/57 |
| 4,027,226 | 6/1977 | Schroeder . | |
| 4,226,292 | 10/1980 | Monte et al. | 446/456 X |
| 4,249,711 | 2/1981 | Godbersen | 244/54 |

FOREIGN PATENT DOCUMENTS

| | | | |
|---|---|---|---|
| 2498468 | 7/1982 | France | 446/456 |
| 2029245 | 3/1980 | United Kingdom | 446/57 |

OTHER PUBLICATIONS

Radio Control Modeler, Mar. 1987, p. 117, P.O. Box 487, Sierra Madre, Calif. 91024.

WO 8603985, Publication date: Jul. 1986, Reginato.

*Primary Examiner*—Mickey Yu

*Attorney, Agent, or Firm*—Palmatier & Sjoquist

[57] ABSTRACT

One feature of the present invention is a removable power and control module for a model airplane wherein the module mounts a great majority of the model airplane components such as the propeller, engine, gas tank, battery, radio receiver and servo motors. Accordingly, since the module is removable, repair and replacement of parts is facilitated. Another feature of the present invention is a number of levels of vibration isolators. One set of vibration suppressing soft mounts isolates the engine from the rest of the module; another set of soft mounts isolates the module from the model airplane. The soft mounts suppress engine produced vibrations which would otherwise be transmitted to the fuselage and skin-like covering of the model airplane and the airplane components. Since such vibrations contribute to the noise of a model airplane and to wear and tear on the airplane components, a quieter and more durable model airplane is an end result.

20 Claims, 4 Drawing Sheets

POWER AND CONTROL MODULE FOR MODEL AIRPLANES

The present invention relates to powered, radio controlled model airplanes and more particularly to a power and control module removably connectable to the fuselage of a powered, radio controlled model airplane.

BACKGROUND OF THE INVENTION

The hobby of flying conventional, powered, radio controlled model airplanes has a number of problems. One of the problems is that a model airplane is difficult to construct and repair. Another problem is that the conventional model airplane is noisy.

One reason for the difficulty in construction is the vast number of distinct components required by a model airplane. For instance, a typical model airplane includes an engine, a battery, a radio receiver for receiving signals from a ground operator with a radio control device, a power switch for turning the engine and battery on and off, a gas tank, a gas tank fill valve, gas lines, a propeller, a spinner for fitting over the hub of the propeller, a nose wheel, a throttle, electrically operated and radio controlled servo motors and servo motor control rod connections to the elevators, rudder, ailerons, throttle and nose wheel.

Each of the airplane components is typically connected to a separate portion of the airplane. Some of the components may be removably connected to their respective portions of a fuselage. Other components may be permanently affixed to their respective portions such as by gluing. Moreover, components may be connected to different areas of the fuselage in different airplanes. With each of the plurality of components affixed to its separate, respective portion of a model airplane, extensive reconstruction is usually required when a plane malfunctions or crashes. The reconstruction may include repair and replacement of any number of components, the fuselage or frame of the plane, or the outer skin-like covering of the plane. Thus, the model airplane hobby not only may be laborious and time consuming, but also become quickly and unpredictably expensive.

As well as being difficult to construct and maintain, a conventional, gas-powered model is noisy. A model airplane typically produces 60–100 decibels in flight. Such airplanes easily violate municipal noise ordinances and hence may not be flown in residential areas. Consequently, some model airplane enthusiasts have turned their attention toward quieter, electrically powered airplanes which unfortunately fly at lower speeds and have lesser capabilities.

SUMMARY OF THE INVENTION

A feature of the present invention is the provision in a radio controlled gas-powered model airplane, of a module upon which is mounted a great majority of the power and control components of such an airplane and wherein the module is readily removable from the airplane in one-piece for maintenance or replacement by another module.

Another feature of the present invention is the provision in a radio controlled gas-powered model airplane, of a number of vibration isolators wherein one set of isolation members is disposed in the module itself between the engine and the remaining portion of the module and wherein another set of isolation members is disposed between the module and the frame of the model airplane.

An advantage of the present invention is that the removable module facilitates construction, maintenance, repair and replacement. The present module mounts almost all of the necessary power and control components on a one-piece frame which is easily removably connectable to the nose portion of an airplane. When the module is removed from the nose portion, the components are readily accessible for maintenance or replacement. Moreover, the module is operable outside of a model airplane.

Another advantage of the present invention is that the vibration isolation members produce a quieter engine. The isolation members suppress or reduce vibrations created by the engine. Applicant has recognized that model airplane noise is created by the engine exhaust, the propeller, and the air frame and its skin-like covering. Reasonable suppression of noise produced by the exhaust has perhaps been achieved with mufflers, and propeller noise may be minimized by proper balancing techniques. However, suppression of airplane-frame noise is still a problem.

Airplane-frame noise occurs as a result of the fuselage, wings and tail assembly acting as amplifiers and loudspeakers for engine vibrations. Engine vibrations are transmitted to the frame and skin-like covering of the fuselage, wings and tail assembly in the same way as string vibrations of a guitar are transmitted by the bridge to the body of the guitar, which then amplifies the vibrations and produces the music or noise as heard by the ear. When in flight, a conventional, gas-powered model airplane with a muffler and a properly balanced propeller may produce anywhere from 60–100 decibels With the vibration isolators or "soft bridges" of applicant's invention, model airplane noise is reduced approximately ten to thirty decibels and hence model airplanes may be flown closer to residential areas.

DETAILED DESCRIPTION OF THE PREFERRED EMBODIMENTS

Figure 1:
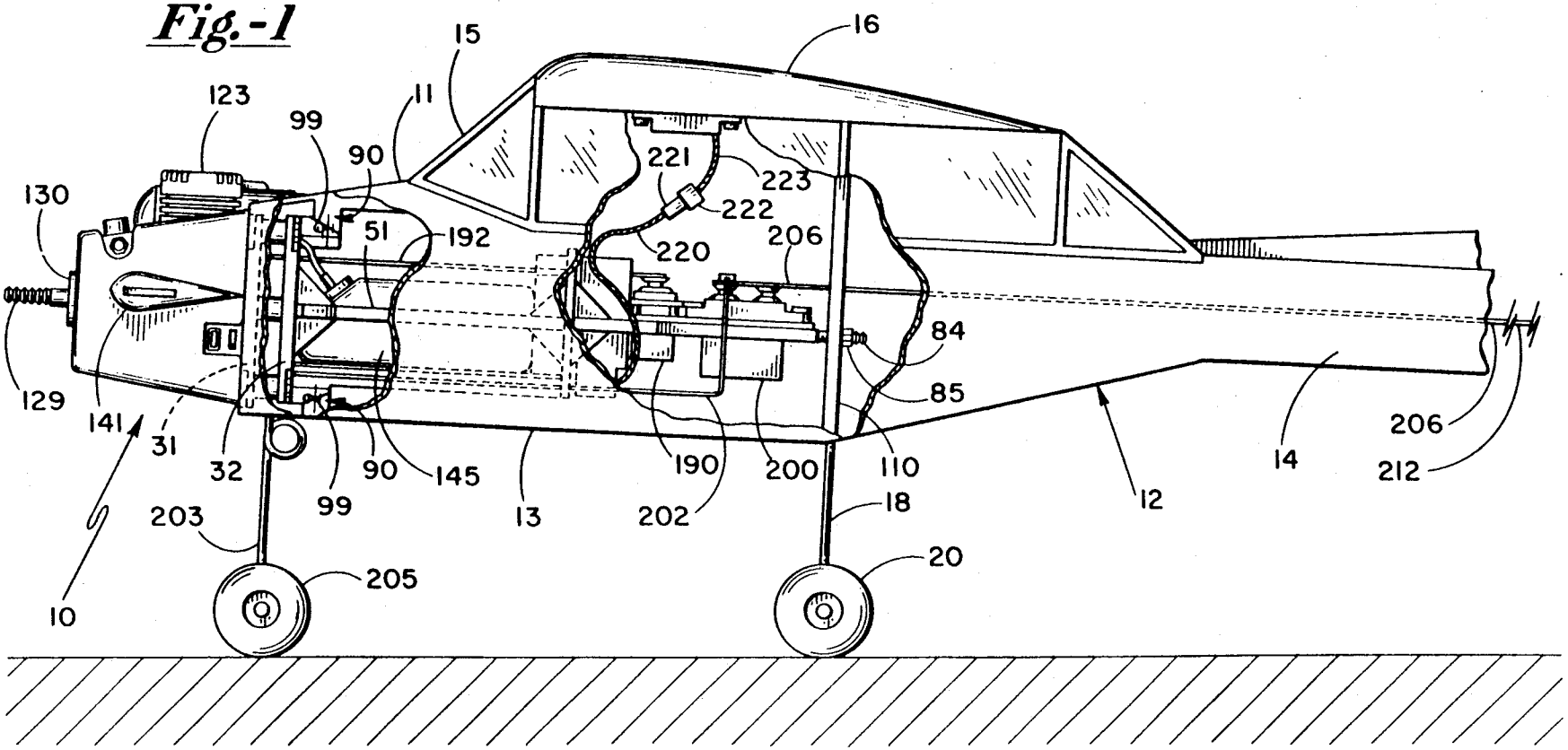
FIG. 1 is a partially cut away, partially phantom, side elevation view of the removable power and control module mounted in a model airplane.
Figure 5:
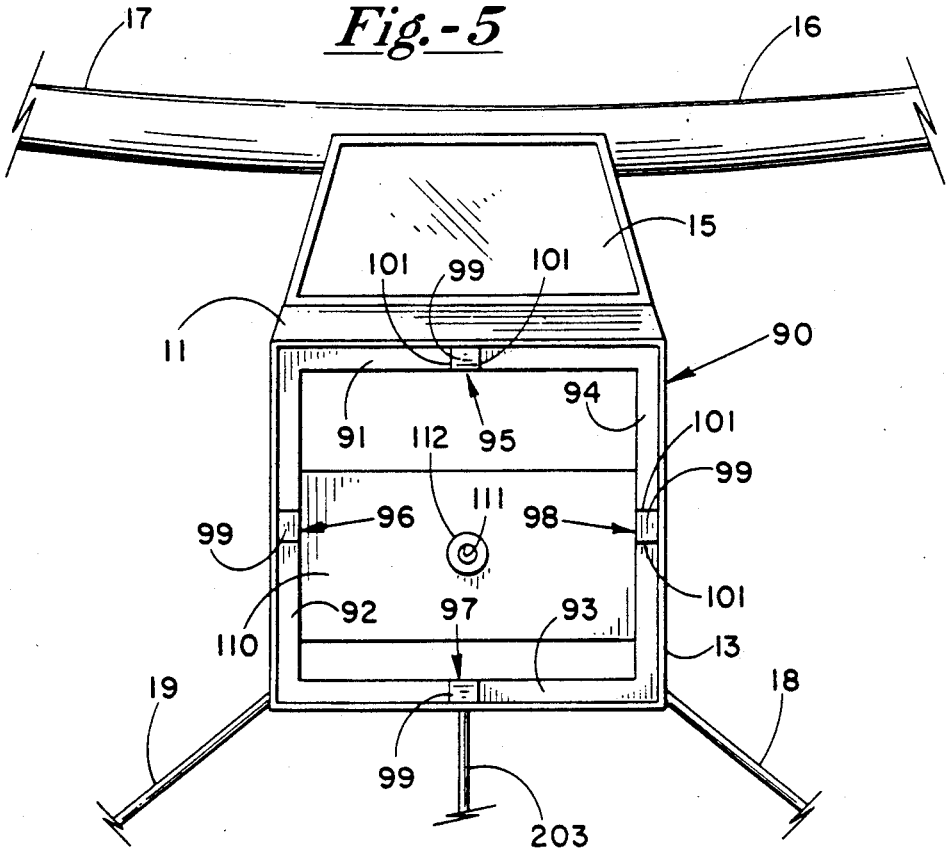
FIG. 5 is a front elevation view of a model airplane adapted for mounting the module shown in FIGS. 1–4.

As shown in FIGS. 1 and 5, a removable power and control module is indicated generally by the reference numeral 10. The module 10 is mounted in a nose portion 11 of a model airplane 12. A model airplane 12 includes a fuselage 13, a tail section 14, a cockpit 15, a pair of wings 16, 17 mounted above the cockpit 15, and a pair of rear landing gear struts 18, 19. Each of the struts 18, 19 is connected to a rear wheel 20.

Figure 2:
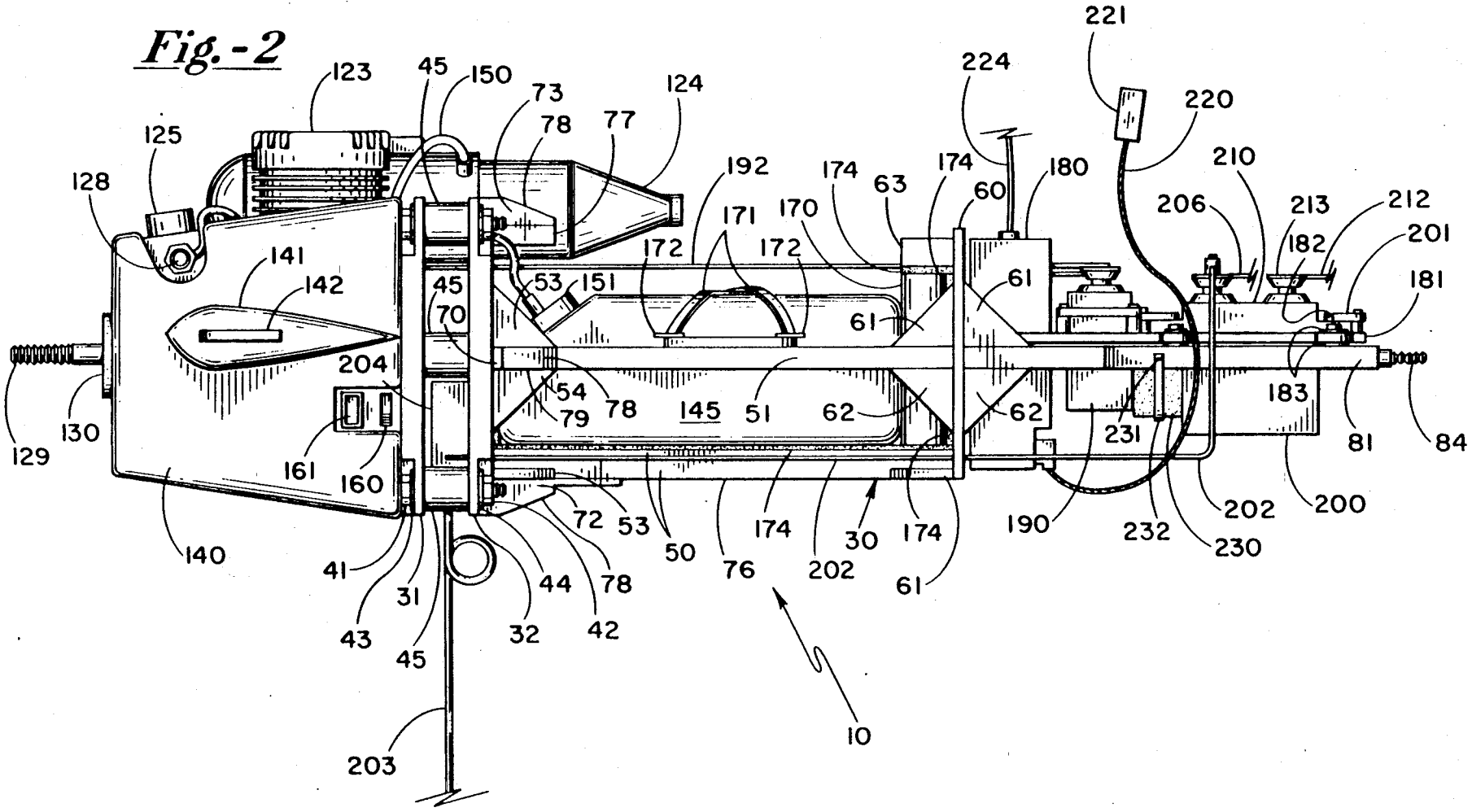
FIG. 2 is a side elevation view of the module.
Figure 3:
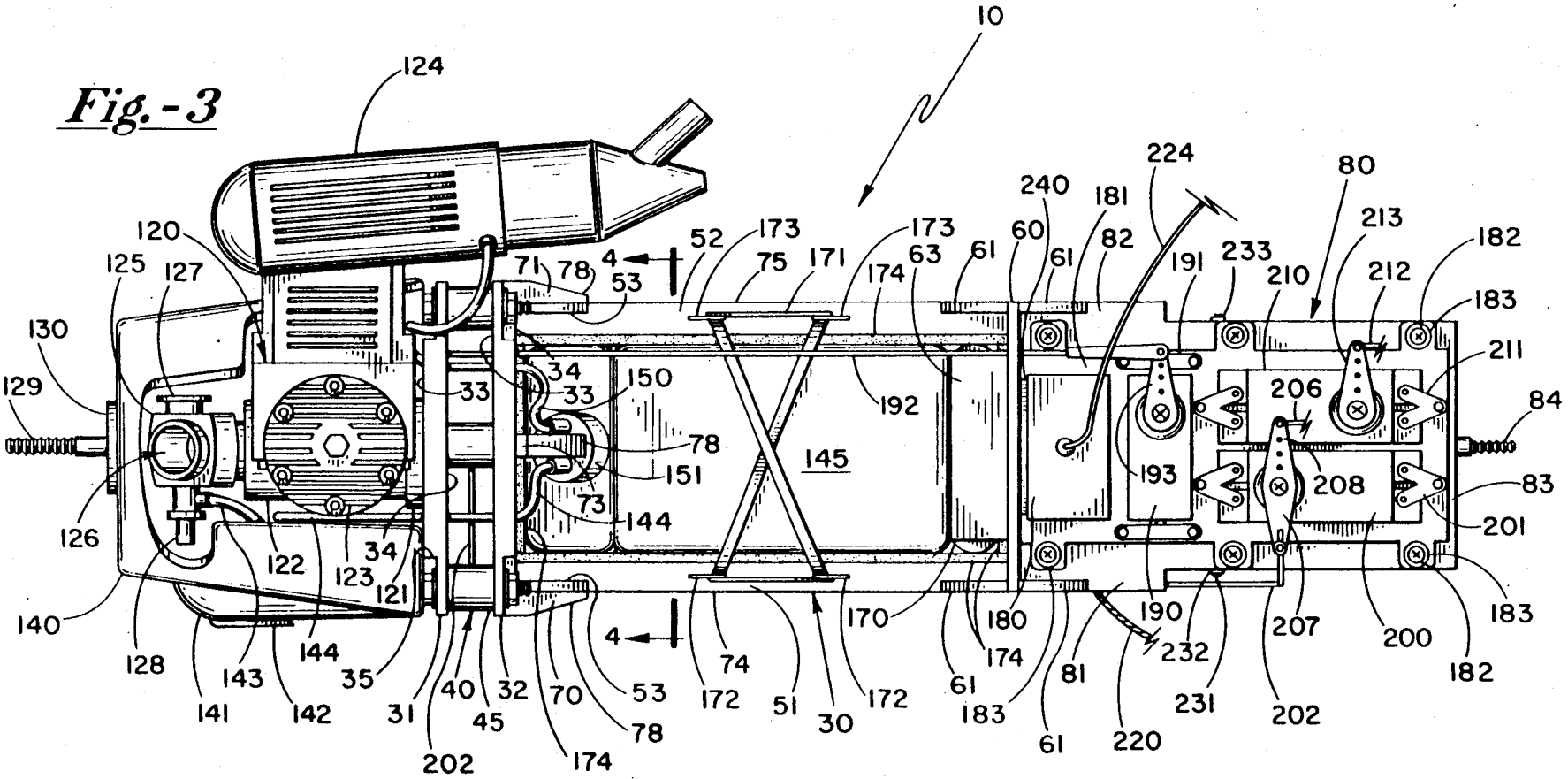
FIG. 3 is a top elevation view of the module.
Figure 4:
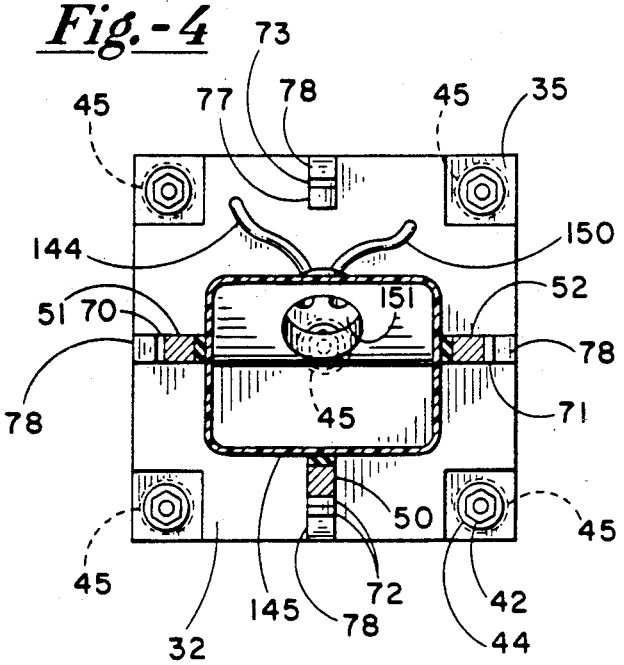
FIG. 4 is a cross section view of the module at lines 4—4 of FIG. 3.

As shown in FIGS. 2, 3 and 4, a frame 30 of the module 10 includes a pair or transverse front and rear square plate members or fire walls 31, 32. Each of the plate members 31, 32 includes a front and rear face 33, 34. The front face 33 of the front plate 31 includes a square recess 35 formed in each of its corners. The rear face 34 of the rear plate 32 includes a similar set of four square recesses 35. The front face 33 of the front plate 31 and the rear face 34 of the rear plate 32 each include a circular recess formed centrally in the respective plates 31, 32.

A set of five isolation members or means 40 affixes the plates 31, 32 to each other. Each of the isolation members 40 includes a threaded pin connector 41, a cooperating nut-like connector 42, a front washer 43 for the pin connector 41, a rear washer 44 for the nut-like connector 42, and a cylindrical rubber-like resilient isolator or tube 45. The ends of each of the isolators 45 bear against the rear face 34 of the front plate 31 and the front face 33 of the rear plate 32. Each of the isolation members 40 is aligned with and between corresponding recesses 35 of the plate members 31, 32. Pressure is brought to bear on the ends of the isolators 45 by the connectors 41, 42 being tightened so as to draw the fire walls 31, 32 together. Each of the pin connectors 41 extends through its respective cylindrical isolator 45.

The frame 30 further includes a set of three longitudinal support beams 50, 51, 52 which are rigidly affixed to the rear plate 32 and extend rearwardly therefrom. Each of the beams 50, 51, 52 is supported relative to the rear plate 32 by a pair of triangular braces 53, 54.

The frame 30 further includes an upright, medial, plate-like support member or bulkhead 60 rigidly connected to the rear ends of the beams 50, 51, 52. Each of the beams 50–52 is supported relative the upright support member 60 by a pair of triangular braces 61, 62. Beam 50 is connected between bottom, central portions of plates 32, 60. Each of the beams 51, 52 is connected between respective side, central portions of plates 32, 60. A battery retaining horizontal bar 63 is rigidly connected to and extends forwardly of a top portion of the plate 60.

A set of four centering, wedge-like resilient isolators 70, 71, 72, 73 is affixed to the rear face 34 of rear plate 32. Respective side isolators 70, 71 are connected to outer sides 74, 75 of the respective side beams 51, 52 and to plate 32. Bottom isolator 72 is connected to an outer side 76 of the bottom beam 50 and to plate 32. Top isolator 73 is affixed to plate 32 and a beam-like member 77 affixed to and extending rearwardly from a top central portion of plate 32. Each of the isolators 70–73 includes an oblique edge or face 78 disposed inwardly and rearwardly relative the plate 32. Each of the isolators 70–73 also includes side faces 79.

The frame 30 also includes a generally U-shaped rear support member 80 which is affixed to and extends rearwardly from plate 60. The member 80 includes a pair of side beams 81, 82 connected to side, central portions of the rear face of the plate 60 and being substantially linear with respective side beams 51, 52. The member 80 also includes a rear lateral beam 83 connected between the rear ends of side beams 51, 52. A threaded pin connector 84 is affixed to and extends rearwardly from a central portion of the rear beam 83. The pin connector 84 cooperates with a threaded washer 85. Beams 81, 82 also include triangular braces 61, 62 for support relative to plate 60.

An inner peripheral square-like nose frame 90 is affixed to the inside, or may form a part of, the fuselage 13 and includes a set of four framing support beam-like members 91, 92, 93 and 94. The support members 91–94 form respective centering slots 95, 96, 97 and 98. Each of the slots 95–98 is formed in part by an oblique surface or face 99 disposed inwardly and rearwardly the relative nose frame 90. The slots 95–98 are also formed by side faces 101 formed in the beams 91–94.

The fuselage 13 also includes a framing plate-like support member 110 connected between the sides of the fuselage 13. A rubber grommet 111 is affixed centrally to the support member 110. The grommet 111 includes an aperture 112.

The front plate or fire wall 31 is typically connected to a two cycle model aircraft engine 120 via a "Lord" type mount 121. The engine 120 includes a crankcase 122, a cylinder head 123 with a glow plug, a muffler 124, a carburetor 125 with an air intake opening 126, carburetor adjustment screws 127 and 128, a propeller drive shaft 129, and a propeller mounting plate 130. A propeller and spinner may be mounted on the drive shaft 129.

A removable cowling 140 is affixed over the engine 120. The cowling 140 includes a tapering protrusion 141 which houses an extendable gas tank filler valve 142. When the valve 142 is extended, a carburetor gas line 143 to the carburetor 125 is closed and a gas line 144 is open for allowing a gas tank 145 to be filled. The gas line 144 is connected between the valve 142 and the plastic gas tank 145 and the gas line 144 extends through apertures formed in the fire walls 31, 32. A gas tank pressure line 150 is connected between the muffler 124 and the gas tank 145. The line 150 extends through apertures formed in the fire walls 31, 32. Pressure produced by the muffler 124 is supplied to the gas tank 145 via the pressure line 150 to maintain gas under pressure in the gas tank 145. One reason for a pressurized gas tank 145 is that model airplanes may perform aerobatic feats such as flying up side down. Lines 145, 150 are connected to the gas tank 145 by a gas tank cap 151.

The module 10 further includes a master switch 160 and female plug battery charging receptacle 161. The switch 160 and receptacle 161 are affixed to and extend forwardly of the front fire wall 31.

The gas tank 145 is removably mounted on the beam-like support member 50, between beam-like support members 51, 52, and between rear fire wall 32 and a battery 170. A rubberband 171 is removably bound to a set of T-shaped pins 172, 173 mounted in respective side support members 51, 52 to clamp the gas tank 145 in the module 10. Disposed between the gas tank 145 and the members 50, 51, 52 and rear fire wall 32 are a plurality of resilient strips 174 of foam-like padding for cushioning purposes such as to reduce frothing of gas.

The battery 170 is slidably and removably mounted between bottom member 50 and its respective braces 61, 62 and top bar 63, and between side members 51, 52 and their respective braces 61, 62. Padding strips 174 are disposed between the battery 170 and the members 50, 51, and 52 and their respective braces 61, 62 and bar 63, and between a rear face of the battery 170 and transverse plate 60. One of the reasons the battery is mounted behind the gas tank 145 is that the gas tank 145 may tend to absorb the impact of the massive battery 170 during, for instance, a crash landing.

A radio receiver and control unit 180 may be mounted to the module 10 via a control plate 181. The control plate 181 is connected between side beams 81, 82 and rear beam 83 by a plurality of pin connectors 182. The control plate 181 is isolated from the pins 182 and the beams 81, 82 by a plurality of rubber-like resilient grommets 183 disposed between the pins 182 and the control plate 181 and between the control plate 181 and the beams 81, 82.

A throttle controlling servo motor 190 is mounted to the control plate 181 by a pair of mounts 191. A throttle control rod 192 extends frontwardly from an arm 193 of the servo motor 190, through apertures formed in plate 60 and fire walls 32, 31 and is connected to a throttle in the engine 120.

A nose wheel and rudder controlling servo motor 200 is mounted to the control plate 181 by a pair of mounts 201. A nose wheel steering control rod 202 extends frontwardly from the servo motor 200 through aperture plates 60 and rear fire wall 32. A front end of the rod 202 is affixed to and controls a stearable nose wheel landing gear strut 203. The landing gear strut is connected to the module 10 via a bearing housing 204 affixed to the front face of the read fire wall 32 and disposed below the central isolator 45. The nose landing gear strut 203 includes a stearable nose wheel 205. The servo motor 200 includes a rudder control rod 206 extending rearwardly to the rudder of the tail section 14. Nose wheel control rod 202 is connected to an arm 207 of the servo motor 200. Rudder control rod 206 is connected to an arm 208 of the servo motor 200. Arms 207 and 208 are integrally formed.

An elevator controlling servo motor 210 is mounted to the control plate 181 by a pair of mounts 211. An elevator control rod 212 extends from an arm 213 of the servo motor 210 and is connected to the elevator of the tail section 14. A first aileron control wire 220 is removably plugged into the control unit 180 and extends to the wings 16, 17 via a coupling 221. A coupling 222 cooperates with a coupling 221 and a second aileron control wire 223 leads from the coupling 222 into the wings 16, 17 where the second wire 223 is connected to an aileron servo motor. An antenna 224 extends from a top portion of the radio receiver and control unit 180.

A resilient foam-like isolator pad 230 may be disposed between the bottom portion of servo motors 190 and 200. The pad 230 is held between the servo motors 190 and 200 and underneath the control panel 181 by a rubber band 231 bound to a pair of T-shaped pin members 232, 233 mounted to outer sides of respective side beams 81, 82.

It should be noted that each of the control rods 192, 202, 206 and 212 is readily disconnectable from its respective servo motor 190, 200, 200 or 210. Each servo motor 190, 200, 210 includes at least one arm with an aperture formed in the end of the arm. Each of the control rods 192, 202, 206, 212 is connected to that aperture via a pin connected to one of two opposing flat steel springs. The springs are rigidly connected to a threaded fastener which longitudinally and adjustably cooperates with the threaded end on one of the control rods 192, 202, 206, 212.

A Velcro strip or a resilient foam-like material 240 may be disposed between a front face of the radio receiver and control unit 180 and a rear face of the bulkhead 60. Hence the radio receiver and control unit 180 may be readily removable from the bulkhead 60.

In operation, to connect module 10 to the model airplane 12, the module 10 is simply inserted into the nose portion 11. As module 10 is inserted, edge-like isolators 70, 71, 72, 73 slide into their respective self-centering slots 98, 96, 97, 95. As the wedge-like isolators 70–73 center the module 10 in the nose portion 11, the pin connector 84 is received by the rubber grommet 111 affixed in frame plate 110. Subsequently, the nut-like connector 85 is threaded on the pin connector 84 to draw the wedge-like isolators 70, 73 into the self-centering oblique slots 95–98 so that the oblique faces 78 of the isolators 70–73 bear against the oblique faces 99 of the nose frame 90 which form the slots 95–98. Side faces 79 of the wedge-like isolators 70–73 may also bear against side faces 99 of the nose frame 90 which form the slots 95–98 so as to preclude lateral or transverse or vertical movement of the module 10 relative to the airplane 12.

After the module 10 has been connected to the model airplane 12, the rudder and elevator control rods 206, 212 are connected to their respective servo arms 208, 213; the first aileron control wire 220 is then connected via couplings 221, 222 to the second aileron control wire 223; the wings 16–17 are then connected to the plane 12; finally, the antenna 224 is then affixed to the outside of the plane 12. The model airplane 12 is hence ready for flight and may be operated by turning the master switch 160 to an on position. To disconnect the module 10 from the airplane 12, the procedure is simply reversed.

Besides the removability of the module 10 from the airplane 12, the module 10 offers a number of advantages. A first stage of noise suppression include the five cylindrical rubber isolators 45 affixed between the fire walls 31, 32 to isolate the vibration producing engine 120 from the frame 30 of the module 10.

A second stage of noise suppression is provided by the rubber-like, wedge-like isolators 70–73 which isolate the already isolated module frame 30 from the airplane 12. Accordingly, each of the isolators 45, 70–73 act as "soft bridges" to suppress vibrations being transmitted from the engine 120. With the model airplane 12 and its skin-like covering vibrating less, the model airplane 12 is quieter. The rubber grommet 111 is included in this second stage of isolation.

A third stage of isolation are the padding strips 174 which isolate the gas tank 145 and battery 170 from the frame 30. One of the problems with the prior art models airplanes is frothing in the gas tank. Frothing is produced in the gas tanks by excess vibrations. When frothing occurs in the gas tank, gas bubbles may be produced in the gas line and an engine may falter or quit in midair. With the present module 10, the gas tank 14 is isolated from the engine 120 not only by the padding strips 174 and the cylindrical rubber isolators 45, but also receives the advantages of the wedge-like isolators 70–73 which reduce vibration of the model airplane 12 as a whole. In other words, vibrations of the fuselage 13 may be suppressed as they are transmitted back and forth between the fuselage 13 and the module 10.

The fourth stage of isolation may include the velcro like material 240 and the rubber grommets 183 which isolate the control panel 181 from the frame 30. The radio receiver and control unit 180 and the servo motors 190, 200, and 210 are typically expensive and delicate components and susceptible to vibration. Vibration may not only contribute to fatigue and early replacement of such components, but also reduce the amount of control over the control rods 192, 202, 206, 212 and control over the aileron control rods. When an operator is flying a model airplane, engine producing vibrations may upset the longitudinal displacement of the control rods. Such unpredicatable longitudinal displacement may result in an undesirable speed, a loss of engine power, or crash landings as the operator attempts to control the model airplane 12 through the radio receiver 180. With the present module 10, the radio receiver and control unit 180 and servo motors 190, 200, 210 are isolated from engine producing vibrations by the rubber grommets 183, velcro material 240, cylindrical rubber mounts 45, and receive the benefit of the wedge-like isolators 70–73 reducing vibration of the model airplane 12 as a whole.

It should also be noted that the nose wheel wall 32. Accordingly, the front landing gear strut 203 is isolated from engine producing vibrations by the cylindrical isolators 45. The front land gear strut 203 and its wheel 205 hence also receive the benefit of the wedge-like isolators 70–73 reducing the vibration of the model airplane 12 as a whole. Thus, softer landings are possible with the module 10, and the front landing gear strut 203 produces less air turbulence when the model airplane 12 is in flight.

It should be noted that another stage of isolation may include the pad means 230 which is mounted between the servo motors 190 and 200. Such as padding may further absorb vibrations.

A further advantage of the module 10 relates to the installation and maintenance of model airplane components. With the exception of the aileron servo, all other power and control components are mounted on the removable module 10. Instead of installing and adjusting airplane components in the limited space and access of a completed fuselage, model airplane components may be installed, adjusted and operated on the module 10 before it is inserted and fastened within the fuselage 13.

Simplified maintenance of the airline components is another advantage. To maintain the module 10, it is simply removed from the airplane 12, thereby providing instant and easy access to the power and control components For example, if a leak develops in the gas tank 145 when the model airplane 12 is in flight, or fuel line 144 breaks, or one of the servo motors 190, 200, 210 is rendered inoperable, or a wiring or other control problem develops, the module 10 is simply removed from the airplane 12 for maintenance and fixed in the field. Moreover, the control rods 192 and 202 for the throttle and stearable landing gear nose 203 have a minimum length, a minimum number of bends, and hence are readily repaired.

Another advantage of the module 10 is that it is crash resistant. The frame 30 may be formed of materials such as wood, or it may be integrally formed by materials such as plastic or aluminum or like metal. Furthermore, the vibration isolators 45, 70–73, 174, 183, 230, 240 contribute to crash resistance by acting as shock absorbers. Moreover, the massive battery 170 is located behind the plastic, semi-flexible gas tank 145 which may absorb the kinetic energy of the massive battery 175 in a crash landing Another advantage of the module 10 is that it includes components for readily adjusting the thrust line of the model airplane 12. For optimizing flying characteristics, it is typical for models to utilize an offset thrust line for the usually such offsets are a few degrees down, a few degrees to the right or both. With conventional aircraft such offsets are often established by the attitude of the motor mounts. Alteration of the attitude of motor mounts may be a major undertaking. Additionally, with coweled radio controlled model aircraft, changing the thrust line of an engine may mean modifications to the cowling. With the present module 10, the engine thrust line of all coweled and non-cowled radio controlled model aircraft may be readily modified by adding or removing a number of washers 43, 44. The washers 43, 44 act as shims to change the thrust line of the engine.

Another advantage of the module 10 is that it provides a better weight distribution for model airplanes. The ideal weight distribution for a radio controlled model aircraft may consist of an equal weight distribution around and as close as possible to its roll axis. This contributes to smoother maneuvers involving rotation of the aircraft around its roll axis, in much the same way as balancing an engine contributes to smoothness. Keeping the weight close to the roll axis minimizes the rotation energy imparted during a roll so that the model's response to a command to roll in the opposite direction is minimized by having less energy to neutralize before the new maneuver commences.

Typically, a model's air frame contributes approximately 50% of a model's total weight. This weight is usually not equally distributed around the model's roll axis. The other 50% is comprised of all the model's power and control components. In conventional model aircraft, the weight of these components is not necessarily equally distributed around the roll axis, nor are these components necessarily mounted as close as possible to the roll axis.

The present power and control module 10 provides for substantially all of the air frame components to be mounted as close as possible to the roll axis and to be reasonably equally distributed around the roll axis, thus contributing to better flying characteristics, stability and smoother maneuvers.

Furthermore, a model airplane 12 with a module 10 is readily balanced around its center of gravity Since tail moments are typically longer than nose moments, it is easier to add weight to the tail as opposed to the nose because the tail provides greater leverage for weight or mass added or removed. Adjustments to establish the correct center of gravity with the present module 10 may include removing weight from a vertical stabilizer or aft section of the fuselage to provide for proper fore and aft weight distribution.

Another advantage of the module 10 is engine flexibility. A docile plane may be converted to a "screamer" simply by replacing the module 10 with another module 10. Conversely, a module 10 may be shared by two different model airplanes.

It should also be noted that the engine 120 may be replaced by an electrically driven motor. With an electric motor, a more powerful battery may replace the battery 170 and gas tank 145.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A power and control module for a model airplane with a nose portion and maneuvering components including a rudder, elevators, stabilizer, wings and ailerons, comprising:

a frame including front and rear sections and a firewall separating the sections, the frame being mountable within the model airplane, power means including a propeller and motor for propelling the model airplane and being mounted on the front section of the frame, control means on the frame including a radio receiver and servomotor for receiving radio signals and connectable to such maneuvering components, the control means implementing the power means and such maneuvering components, energy source containing means on the frame for containing an energy source to be supplied to the motor, radio receiver and servomotor, means for connecting the frame to the model airplane, the connecting means including centering means on the frame cooperating with the model airplane to orient the module in the model airplane whereby the module is operable in or out of the model airplane and readily connectable to the model airplane to facilitate installation, maintenance, repair and reconstruction of the frame, the power means, the control means, the energy source containing means, the connecting means and other components of the model airplane.

2. The module of claim 1, wherein the module is removably connectable to the nose portion of the airplane.

3. The module of claim 1, wherein the firewall includes at least two spaced apart plates being separated by a first vibration isolating means for isolating the front section of the module from the rear section of the module and for suppressing vibrations being transmitted therebetween, the first vibration isolating means being disposed between the two spaced apart plates so that motor produced vibrations are suppressed relative the rear section of the module.

4. The module of claim 1, wherein the rear section of the module includes a vibration isolating means for isolating the module from the model airplane and for suppressing vibrations being transmitted therebetween, the vibration isolating means being disposed between the rear section of the module and the model airplane, the vibration isolating means suppressing motor produced vibrations relative the model airplane.

5. The module of claim 1, wherein the motor includes a gas powered engine and the energy source containing means includes a gas tank and a battery, the gas tank supplying gas to the gas powered engine and the battery supplying electrical energy to the radio receiver and servomotor.

6. The module of claim 1, wherein the module includes a vibration isolating means for isolating the energy source containing means from the frame and for suppressing vibrations begin transmitted between the frame and the energy source containing means, the vibration isolating means being disposed between the frame and the energy source containing means.

7. The module of claim 1, wherein the power means includes a power controlling means in the motor for increasing and decreasing the power output of the motor, and wherein the control means includes a control panel mounting servomotors with control rods connectable to the elevators and rudder of the model airplane and the power controlling mans of the module.

8. The module of claim 1, wherein the module includes a vibration isolating means for isolating the control means from the frame and for suppressing vibrations being transmitted therebetween, the vibration isolating means being disposed between the frame and the control means.

9. The module of claim 3, wherein the first vibration isolating means includes a cylindrical resilient spacer disposed between the spaced apart plates and having ends bearing against the spaced apart plates.

10. The module of claim 4, wherein the vibration isolating means includes at least one resilient isolating wedge affixed to the rear section of the module, the resilient wedge being drawn against the nose portion of the model airplane by the connecting means when the module is being connected in the model airplane, the connecting means being isolated from the model airplane.

11. The module of claim 10 and the nose of the model airplane including a wedge-receiving slot, wherein the wedge is receivable in the wedge-receiving slot to orient the module in the nose portion of the model airplane.

12. The module of claim 6, wherein the vibration isolating means includes a resilient foam-like padding.

13. The module of claim 8, wherein the vibration isolating means includes a resilient grommet affixed between the control means and frame for receiving a pin connector connecting the control means to the frame.

14. The module of claim 7, wherein the module further includes a nose wheel and wherein the control means includes a nose wheel servomotor for steering the nose wheel.

15. The module of claim 5, wherein the battery is mounted rearwardly of the gas tank relative to the firewall so that gas tank absorbs the kinetic energy of the battery in the event of a crash landing.

16. The module of claim 3 wherein the plates are connected to each other by at least three adjustable holding means for holding the plates in a spaced apart orientation and for being adjustable to offset the thrust line of the model airplane, the holding means adjusting the angle at which the plates are disposed relative each other.

17. The module of claim 3, wherein the rear section of the module includes a second vibration isolating means for isolating the module from the model airplane and for suppressing vibrations being transmitted therebetween, the second vibration isolating means being disposed between the rear section of the module and the model airplane, the second vibration isolating means suppressing motor produced vibrations relative the model airplane.

18. The module of claim 17, wherein the motor includes a gas powered engine and the energy source containing means includes a gas tank and a battery, the gas tank supplying gas to the gas powered engine and the battery supplying electrical energy to the radio receiver and servomotor.

19. The module of claim 18, wherein the module includes a third vibration isolating means for isolating the gas tank and battery from the rear section of the frame and for suppressing vibrations being transmitted between the rear section of the frame and the gas tank and battery, the third vibration isolating means being disposed between the rear section of the frame and the gas tank and battery.

20. The module of claim 19, wherein the power means includes a power controlling means in the motor for increasing and decreasing the power output of the motor, the control means including a control panel mounting servomotors with control rods connectable to the elevators and rudder of the model airplane and the power controlling means of the module, and a fourth vibration isolating means being disposed between the frame and the control means for isolating the control means from the frame and for suppressing vibrations being transmitted therebetween.

* * * * *

UNITED STATES PATENT AND TRADEMARK OFFICE

CERTIFICATE OF CORRECTION

PATENT NO. : 5,078,638

DATED : January 7, 1992

INVENTOR(S) : Joseph Molina

It is certified that error appears in the above-identified patent and that said Letters Patent is hereby corrected as shown below:

Column 7, line 3, after "wheel" and before "wall", insert --bearing portion 204 is mounted on the fire--.

Column 7, line 55, after "the" and before "such", delete "usually" and replace it with --motor. Usually--.

Column 8, line 67, after "the" and before "power", insert --radio signals by operating the--.

Column 9, line 54, after "controlling" delete "mans", and replace it with --means--.

Signed and Sealed this

Sixth Day of April, 1993

*Attest:*

STEPHEN G. KUNIN

*Attesting Officer*

*Acting Commissioner of Patents and Trademarks*